US006398949B1

(12) United States Patent
Wu et al.

(10) Patent No.: US 6,398,949 B1
(45) Date of Patent: Jun. 4, 2002

(54) SAPO-SUPPORTED HYDRODESULFURIZATION CATALYST AND PROCESSES THEREFOR AND THEREWITH

(75) Inventors: An-hsiang Wu, Kingwood, TX (US); Charles A. Drake, Nowata; Joseph E. Bares, Bartlesville, both of OK (US)

(73) Assignee: Phillips Petroleum Company, Bartlesville, OK (US)

( * ) Notice: Subject to any disclaimer, the term of this patent is extended or adjusted under 35 U.S.C. 154(b) by 0 days.

(21) Appl. No.: 09/704,813

(22) Filed: Nov. 2, 2000

(51) Int. Cl.[7] ..... C10G 45/00; C10G 45/04; C10G 45/60

(52) U.S. Cl. ..... 208/208 R; 208/209; 208/211; 208/213; 208/216 R; 208/217

(58) Field of Search ..... 208/208 R, 209, 208/211, 213, 216 R, 217

(56) References Cited

U.S. PATENT DOCUMENTS

| | | | | | |
|---|---|---|---|---|---|
| 3,957,625 | A | * | 5/1976 | Orkin | 208/211 |
| 4,695,368 | A | | 9/1987 | Ward | 208/111 |
| 4,913,798 | A | | 4/1990 | Gortsema et al. | 208/111 |
| 5,916,433 | A | * | 6/1999 | Tejada et al. | 208/254 H |
| 6,083,379 | A | * | 7/2000 | Drake et al. | 208/218 |

* cited by examiner

*Primary Examiner*—Walter D. Griffin
*Assistant Examiner*—Tam M. Nguyen
(74) *Attorney, Agent, or Firm*—Richmond, Hitchcock, Fish & Dollar

(57) ABSTRACT

A catalyst composition comprising a cobalt compound, a molybdenum compound, and a SAPO molecular sieve is used to hydrodesulfurize a hydrocarbon feed containing organic sulfur compounds.

21 Claims, No Drawings

SAPO-SUPPORTED HYDRODESULFURIZATION CATALYST AND PROCESSES THEREFOR AND THEREWITH

The present invention relates to a catalyst and process for hydrodesulfurizing hydrocarbon streams.

BACKGROUND OF THE INVENTION

Naphtha streams are primary products in petroleum refineries. These naphtha streams are typically blended to make up what is referred to in the industry as the "gasoline pool". Naphtha streams contain valuable olefins and aromatics which contribute to the octane number of the gasoline pool. However, one problem associated with such naphtha streams, especially those which are products of a cracking process, such as fluidized catalytic cracking, is that they contain relatively high levels of sulfur. Although cracked naphthas typically constitute less than 40 percent of the total gasoline pool, cracked naphthas frequently contribute over 70 percent of the sulfur to the gasoline pool.

Due to ever stricter government regulations limiting the amount of sulfur in gasoline, there is a continuing need for improved processes and catalysts for hydrodesulfurizing hydrocarbon streams so that the sulfur level of the gasoline pool can be lowered. Although a variety of hydrodesulfurization processes and catalysts are in commercial use today, conventional hydrodesulfurization processes capable of removing a substantial amount of sulfur from hydrocarbon streams typically cause significant octane loss. Thus, there exists a continuing need for improved hydrodesulfurization processes and catalysts which maximize sulfur removal while minimizing octane loss.

SUMMARY OF THE INVENTION

An object of this invention is to provide a process and catalyst for hydrodesulfurizing a hydrocarbon stream, whereby the conversion of organic sulfur compounds to inorganic sulfur compounds is maximized while octane loss is minimized.

A further object of this invention is to provide a process and catalyst for hydrodesulfurizing a hydrocarbon stream, whereby the conversion of organic sulfur compounds to inorganic sulfur compounds is maximized while saturation of aromatic compounds is minimized.

A still further object of this invention is to provide a process and catalyst for hydrodesulfurizing a hydrocarbon stream, whereby the conversion of organic sulfur compounds to inorganic sulfur compounds is maximized while saturation of olefins is minimized.

Further objects and advantages of the present invention will become apparent from consideration of the detailed description of the invention and appended claims.

In accordance with another embodiment of the present invention, a hydrodesulfurization process is provided. The hydrodesulfurization process comprises contacting a hydrocarbon feed containing a concentration of organic sulfur compounds and a concentration of aromatic compounds with a catalyst composition comprising a cobalt compound, a molybdenum compound, and a SAPO molecular sieve under conditions sufficient to convert a portion of the organic sulfur compounds to inorganic sulfur compounds.

In a fourth embodiment of the present invention, a hydrodesulfurization process is provided. The process comprises separating a full range hydrocarbon feed containing organic sulfur compounds and aromatic compounds into a heavy hydrocarbon fraction and a light hydrocarbon fraction, contacting the heavy hydrocarbon fraction with a catalyst composition comprising a cobalt compound, a molybdenum compound, and a SAPO molecular sieve under conditions sufficient to convert a portion of the organic sulfur compounds to inorganic sulfur compounds, and combining the hydrodesulfurized heavy hydrocarbon product with the light hydrocarbon fraction to produce a hydrodesulfurized full range hydrocarbon product.

DETAILED DESCRIPTION OF THE INVENTION

The present invention employs a catalyst composition comprising a cobalt compound, a molybdenum compound, and a SAPO molecular sieve.

As used herein, the term "SAPO" shall mean a silicoaluminophosphate molecular sieve. Details relating to the formation of SAPO compositions can be found in Lok et al. U.S. Pat. No. 4,440,871, the entire disclosure of which is expressly incorporated herein by reference. Preferably, the SAPO molecular sieve employed in the present invention has an essentially chemical composition in the as-synthesized and anhydrous form which can be represented as follows:

$$mR:(Si_xAl_yP_z)O_2$$

wherein "R" represents at least one organic templating agent present in the intracrystalline pore system; "m" represents the moles of "R" present per mole of $(Si_xAl_yP_z)O_2$, and "x", "y", and "z" represent the mole fractions of silicon, aluminum, and phosphorous, respectively.

In the above formula, nonlimiting examples of a suitable organic templating agent, "R", include tetramethylammonium hydroxide, tetraethylammonium hydroxide, and tetrapropyammonium hydroxide. In the above formula, "m" is preferably from about zero to about 0.3, more preferably from zero to 0.06; "x" is preferably from about 0.02 to about 0.98, more peferably from 0.10 to 0.30; "y" is preferably from about 0.02 to about 0.60, more preferably from 0.30 to 0.50; and "z" is preferably from about 0.02 to about 0.60, more preferably from 0.30 to 0.50.

SAPO compositions useful in the present invention include, but are not limited to, SAPO-4, SAPO-5, SAPO-11, SAPO-16, SAPO-17, SAPO-20, SAPO-31, SAPO-34, SAPO-35, SAPO-37, SAPO-40, SAPO-41, SAPO-42, and SAPO-44. The presently more preferred SAPO is SAPO-5.

The catalyst composition preferably contains from about 10 weight percent to about 95 weight percent of the SAPO molecular sieve, more preferably from 25 weight percent to 75 weight percent of the SAPO molecular sieve.

The cobalt compound and molybdenum compound of the catalyst composition may be present either in elemental form or any other suitable form. The amount of cobalt compound present in the catalyst composition is preferably such that the weight of the cobalt component of the cobalt compound as a percentage of the total weight of the catalyst composition is from about 0.1 percent to about 10 percent, more preferably from about 0.5 percent to about 5 percent, and most preferably from 1 percent to 3 percent. The amount of molybdenum compound present in the catalyst composition is preferably such that the weight of the molybdenum component of the molybdenum compound as a percentage of the total weight of the catalyst composition is from about 1 percent to about 50 percent, more preferably from about 2 percent to about 25 percent, and most preferably from 3 percent to 10 percent. The atomic ratio of cobalt to molybdenum in the catalyst composition is preferably from about 0.1:1 to about 10:1, more preferably from 0.2:1 to 2:1.

The catalyst composition can further comprise an inorganic oxide. The inorganic oxide is preferably silica or alumina, with silica being especially preferred. The catalyst composition preferably contains from about 10 weight percent to about 90 weight percent inorganic oxide, more preferably from 25 weight percent to 75 weight percent inorganic oxide.

The catalyst composition is preferably pre-sulfided in a manner such that it contains from about 0.1 weight percent to about 10 weight percent sulfur, more preferably from 1 weight percent to 5 weight percent sulfur.

The catalyst composition can be made by incorporating a cobalt compound and a molybdenum compound into a SAPO molecular sieve, and sulfiding the cobalt/molybdenum-modified catalyst composition.

Either before or after, preferably before, incorporating the cobalt and molybdenum compounds into the SAPO molecular sieve, the SAPO molecular sieve can be mixed with a carrier to bind the SAPO molecular sieve and give the catalyst additional strength. The carrier can be a natural or synthetically produced inorganic oxide or a combination of inorganic oxides. The amount of carrier mixed with the SAPO molecular sieve is preferably an amount such that the weight ratio of the SAPO molecular sieve to the carrier is from about 0.2:1 to about 5:1, more preferably from 0.5:1 to 2:1. After mixing the SAPO molecular sieve and the carrier, the resulting mixture can be formed into individual catalyst pieces by any method known in the art such as, for example, extruding or pelletizing. Thereafter, the individual catalyst pieces are preferably calcined.

The cobalt compound and molybdenum compound can be incorporated into the SAPO molecular sieve in any suitable manner known in the art such as, for example, equilibrium adsorption, incipient wetness impregnation, pore filling, or ion exchange. Preferably, the cobalt compound and molybdenum compound are incorporated in the catalyst composition by incipient wetness impregnation. The cobalt compound and molybdenum compound can be incorporated in the catalyst composition sequentially or simultaneously, with simultaneous impregnation being the preferred method.

Preferably, the incorporation of the cobalt compound and the molybdenum compound into the SAPO molecular sieve is accomplished by contacting the SAPO molecular sieve with an aqueous solution containing both the cobalt compound and the molybdenum compound. Examples of cobalt compounds suitable for use in the incorporation step include, but are not limited to, cobalt nitrate, cobalt acetate, cobalt carbonate, cobalt oxide, cobalt sulfate, cobalt thiocyanate, and the like and mixtures of any two or more thereof. Examples of molybdenum compounds suitable for use in the incorporation step include, but are not limited to, ammonium heptamolybdate, ammonium molybdate, sodium molybdate, potassium molybdate, molybdenum oxides such as molybdenum (IV) oxide and molybdenum (VI) oxide, molybdenum sulfide, and the like and mixtures of any two or more thereof. Preferably, the aqueous solution contacted with the SAPO molecular sieve comprises cobalt nitrate and ammonium heptamolybdate.

After impregnation, the modified molecular sieve bearing the metal(s) can be dried at about 80° C. to about 250° C., preferably 100° C. to 150° C., for about 0.5 hours to about 20 hours, preferably 1 hour to 5 hours. It is preferred for the modified support to be calcined at about 450° C. to about 860° C., preferably 550° C. to 650° C., for about 0.5 hours to about 20 hours, preferably 3 hours to 9 hours, after incorporation of the metals.

The cobalt/molybdenum-modified catalyst is preferably pre-sulfided. Preferred pre-sulfiding methods include, for example, heating the catalyst in a stream of hydrogen sulfide and hydrogen or by flowing an easily decomposible sulfur compound such as carbon disulfide, di-t-nonylpolysulfide (TNPS) or dimethyldisulfide with or without a hydrocarbon solvent, over the catalyst at elevated temperatures up to, but not limited to 500° C. at atmospheric or higher pressures, in the presence of hydrogen gas for 2 to 24 hours. Most preferably, pre-sulfiding is accomplished by contacting the cobalt/molybdenum-modified catalyst with a carbon disulfide-saturated stream of hydrogen for 0.5 hours to 5 hours at a temperature of from 350° C. to 450° C.

In accordance with an embodiment of the present invention, a hydrodesulfurization process is provided which comprises contacting a hydrocarbon feed with a catalyst composition comprising a cobalt compound, a molybdenum compound, and a SAPO molecular sieve.

The feed to the hydrodesulfurization process of the present invention is preferably an organic sulfur-containing hydrocarbon feed that boils in the gasoline boiling range. Examples of organic sulfur-containing hydrocarbon feeds suitable for use in the process of the present invention include thermally cracked naphthas such as pyrolysis gas, coker naphtha, and visbreaker naphtha, as well as catalytically cracked naphthas such as thermofor catalytic cracking (TCC) or fluid catalytic cracking (FCC) naphtha. Preferably, the organic sulfur-containing hydrocarbon feed is catalytically cracked naphtha, most preferably FCC naphtha.

The organic sulfur compounds present in the organic sulfur-containing hydrocarbon feed can be represented by the formula RSR'. RSR' is preferably (1) a thiol or mercaptan, where R is a hydrocarbyl and R' is hydrogen, (2) a sulfide or disulfide, where the sulfur is connected to another sulfur atom in R or R' hydrocarbyl groups, and/or (3) a thiophene, where R and R' are connected to form a heterocyclic ring.

During hydrodusulfurization, the desired reaction is the reaction of organic sulfur compounds with hydrogen to produce inorganic sulfur compounds, typically hydrogen sulfide. However, one problem associated with conventional hydrodesulfurization processes is that olefinic and aromatic compounds present in the hydrocarbon feed also react with hydrogen, resulting in saturation of the olefins and aromatics. This saturation of olefins and aromatics can dramatically decrease the octane number of the hydrocarbon stream being processed.

In most organic sulfur-containing hydrocarbon streams, such as cracked naphthas, the majority of the olefinic compounds are present in the light hydrocarbon fraction, while the majority of the aromatic and organic sulfur compounds are present in the heavy hydrocarbon fraction. It has been discovered that sulfur can be removed from a hydrocarbon stream with minimal olefin saturation by hydrodesulfurizing only the heavy hydrocarbon fraction. In order to ensure adequate desulfurization of the heavy hydrocarbon fraction without a significant loss in octane, the heavy hydrocarbon fraction is preferably contacted with a hydrodesulfurization catalyst which is effective to maximize the conversion of organic sulfur compounds to inorganic sulfur compounds, while minimizing the conversion of aromatic compounds to non-aromatic compounds.

In accordance with another embodiment of the present invention, a process is provided which comprises separating a full range hydrocarbon stream into a heavy hydrocarbon fraction and a light hydrocarbon fraction, hydrodesulfurizing the heavy hydrocarbon fraction by contacting it with a catalyst composition comprising a cobalt compound, a molybdenum compound and a SAPO molecular sieve, and recombining the hydrodesulfurized heavy hydrocarbon fraction with the light hydrocarbon fraction.

The "cut point temperature" used to separate the full range hydrocarbon stream into a heavy hydrocarbon fraction and a light hydrocarbon fraction can vary according to the organic sulfur compounds present and the degree of desulfurization required. A cut point temperature in the range of from about 150° F. to about 350° F. is preferred, with a cut point temperature in the range of 200° F. to 300° F. being most preferred. Cut point temperatures towards the lower end of the given range will typically be necessary for lower product sulfur specifications while cut point temperatures towards the upper end of the given range may be used to minimize octane loss.

The full range hydrocarbon feed employed in the present invention typically boils in the range of from about 80° F. to about 500° F., more typically from 100° F. to 450° F. The full range hydrocarbon feed preferably contains aromatic compounds in an amount such that the weight of aromatic compounds as a percentage of the weight of the total full range hydrocarbon feed is from about 10 percent to about 50 percent, more preferably from 20 percent to 40 percent. The full range hydrocarbon feed preferably contains olefinic compounds in an amount such that the weight of olefinic compounds as a percentage of the weight of the total full range hydrocarbon feed is from about 10 percent to about 50 percent, more preferably from 15 percent to 40 percent. The concentration of sulfur in the full range hydrocarbon feed is preferably from about 5 ppmw to about 5000 ppmw, more preferably from 50 ppmw to 1000 ppmw. Most preferably, the full range hydrocarbon feed is catalytically cracked naphtha.

The heavy hydrocarbon fraction preferably boils in the range of from about 200° F. to about 500° F., more preferably from 250° F. to 450° F. The heavy hydrocarbon fraction preferably contains a concentration of aromatic compounds such that the weight of aromatic compounds as a percentage of the total weight of the heavy hydrocarbon fraction is from about 10 percent to about 95 percent, more preferably from about 30 percent to about 90 percent and most preferably from 50 percent to 80 percent. The heavy hydrocarbon fraction preferably contains a concentration of olefinic compounds in an amount such that the weight of olefinic compounds as a percentage of the total weight of the heavy hydrocarbon fraction is from about 0 to about 20 weight percent, more preferably from about 0 to about 5 weight percent, and most preferably from 0 to 2 weight percent. The heavy hydrocarbon fraction preferably contains a concentration of sulfur of from about 10 ppmw to about 10,000 ppmw, more preferably from 100 ppmw to 2,000 ppmw.

Typically, the bulk of the organic sulfur compounds and aromatic compounds which are present in the full range hydrocarbon feed are located in the heavy hydrocarbon fraction, while only a small percentage of the olefins present in the full range hydrocarbon feed are located in the heavy hydrocarbon fraction. Preferably, the concentration (ppmw) of organic sulfur compounds in the heavy hydrocarbon fraction is more than about 150 percent of the concentration (ppmw) of organic sulfur compounds in the full range hydrocarbon feed, more preferably more than about 300 percent, and most preferably more than 400 percent. Preferably, the concentration (wt. %) of aromatic compounds in the heavy hydrocarbon fraction is more than about 150 percent of the concentration (wt. %) of aromatic compounds in the full range hydrocarbon feed, more preferably more than about 200 percent, and most preferably more than 300 percent. Preferably, the concentration (wt. %) of olefinic compounds in the heavy hydrocarbon is less than about 50 percent of the concentration (wt. %) of olefinic compounds in the full range hydrocarbon feed, more preferably less than about 20 percent, and most preferably less than 5 percent.

The hydrodesulfurization process of the present invention can take place in any suitable reactor by contacting the hydrocarbon feed with the catalyst composition described in the first embodiment of the present invention under reaction conditions sufficient to convert a portion, preferably a substantial portion, of the organic sulfur compounds in the hydrocarbon feed to inorganic sulfur compounds, such as hydrogen sulfide. Suitable reactors include, for example, a fixed bed reactor system, hepulated bed reactor system, fluidized bed reactor system, moving bed, slurry reactor system, and the like. In the case of fixed bed reactor system, the reaction zone may consist of one or more fixed bed reactors and may comprise a plurality of catalyst beds. It is preferred to use extrudates, pellets, pills, spheres or granules of the catalyst in a fixed bed reactor system, under conditions where substantial feed vaporization occurs.

Hydrodesulfurization reaction conditions can include a reaction temperature of from about 100° C. to about 500° C., preferably from 150° C. to 400° C. The reaction pressure is preferably from about atmospheric pressure to about 5000 psig, more preferably from 50 psig to 2000 psig. The weighted hourly space velocity (WHSV) of the hydrocarbon feed is preferably from about 0.1 $hr^{-1}$ to about 10 $hr^{-1}$, more preferably from 0.2 $hr^{-1}$ to 5 $hr^{-1}$.

A hydrogen-containing stream can be added to the hydrocarbon feed prior to and/or during the hydrodesulfurization reaction. The hydrogen stream can be pure hydrogen or can be in admixture with other components found in refinery hydrogen streams. It is preferred that the hydrogen-containing stream contain little, if any, hydrogen sulfide. The hydrogen stream purity should be at least about 50% by volume hydrogen, preferably at least about 65% by volume hydrogen, and most preferably at least 75% by volume hydrogen for best results. The hydrogen to hydrocarbon ratio employed in the inventive hydrodesulfurization process is preferably from about 0.1:1 to about 100:1, more preferably from 0.2:1 to 50:1.

The hydrodesulfurized hydrocarbon product produced by the inventive comprises inorganic sulfur compounds, typically hydrogen sulfide. The inorganic sulfur compounds can be removed before or after, preferably before, recombining the hydrodesulfurized heavy hydrocarbon fraction and the light hydrocarbon fraction. Conventional processes for removing inorganic sulfur compounds from a hydrocarbon stream include, for example, gas sparging, caustic scrubbing, amine treating, absorption, flashing, and conventional gas-liquid separation.

The hydrodesulfurized heavy hydrocarbon product produced by the inventive process preferably contains a concentration (ppmw) of organic sulfur compounds which is less than about 25 percent of the concentration (ppmw) of organic sulfur compounds in the heavy hydrocarbon fraction fed to the reactor, more preferably less than about 15 percent, and most preferably less than 10 percent. The hydrodesulfurized heavy hydrocarbon product preferably contains a concentration (wt. %) of aromatic compounds that is more than about 90 percent of the concentration (wt. %) of aromatic compounds in the heavy hydrocarbon feed, more preferably more than about 95 percent, and most preferably more than 98 percent.

After the heavy hydrocarbon fraction has been hydrodesulfurized to produce a hydrodesulfurized heavy hydrocarbon product, the hydrodesulfurized heavy hydrocarbon product can be recombined with the light hydrocarbon fraction to produce a hydrodesulfurized full range hydrocarbon product. The hydrodesulfurized full range hydrocarbon product preferably has a concentration (ppmw) of organic sulfur compounds that is less than about 25 percent of the concentration (ppmw) of organic sulfur compounds in the full range hydrocarbon feed, more preferably less than about 15 percent, and most preferably less than 10 percent. The hydrodesulfurized full range hydrocarbon product preferably contains a concentration (wt. %) of aromatic compounds which is more than about 95 percent of the concentration (wt. %) of aromatic compounds in the full range hydrocarbon feed, preferably more than about 97 percent, most preferably more than 99 percent. The hydrodesulfurized full range hydrocarbon product preferably has a research octane number (RON) which is more than about 95 percent of the RON of the full range hydrocarbon feed, preferably more than about 97 percent, most preferably more than 99 percent.

The following examples are presented to further illustrate the invention and are not considered as limiting the scope of the invention.

EXAMPLE I

This example demonstrates methods of preparing conventional and inventive hydrodesulfurization catalysts.

Catalyst A (conventional) was prepared by calcining and presulfiding a commercially available $CoMo/Al_2O_3$ hydrodesulfurization catalyst ("TK-554", provided by Haldor-Topsoe, Inc., Houston, Tex.). The commercial catalyst was calcined in air at 500° C. for 3 hours. The calcined catalyst was then presulfiding for 2 hours at 400° C. with a carbon disulfide-saturated stream of hydrogen, flowing at 100 mL/min.

The resulting catalyst was designated Catalyst A.

Catalyst B (inventive) was prepared by physically mixing 15 grams of silicoaluminophosphate powder ("SAPO-5", provided by UOP, Des Plaines, Ill.) with 15 grams of a colloidal silica binder ("Ludox AS-40", provided by DuPont, Wilmington, Del.). The mixture was extruded into 1/16" extrudate which was calcined in air at 538° C. for 6 hours. 8.03 grams of the extrudate was impregnated with 8.04 grams of an aqueous solution containing 20 wt. % ammonium heptamolybdate and 20 wt. % citric acid. The Mo-modified extrudate was then calcined in air at 538° C. for 6 hours followed by imprengation with 6.30 grams of an aqueous solution containing 16 wt. % cobalt nitrate and 20 wt. % citric acid. The Co/Mo-modified extrudate was then calcined in air at 538° F. for 6 hours. The Co/Mo-modified catalyst was presulfided for 2 hours at 400° C. with a carbon disulfide-saturated stream of hydrogen, flowing at 100 mL/min.

The resulting catalyst was designated Catalyst B.

Catalyst C (inventive) was prepared by physically mixing 15 grams of silicoaluminophosphate powder (SAPO-5", provided by UOP, Des Plaines, Ill.) with 10 grams of an alumina binder ("Catapal D", provided by Vista Chemical Co., Houston, Tex.) and 29.31 grams of 10 wt. % acetic acid. The mixture was extruded into 1/16" extrudate which was calcined in air at 538° C. for 6 hours. 8.05 grams of the extrudate was impregnated with 7.42 grams of an aqueous solution containing 20 wt. % ammonium heptamolybdate, 16 wt. % cobalt nitrate, and 20 wt. % citric acid. The impregnated catalyst was then calcined in air at 538° C. for 6 hours. The Co/Mo-modified catalyst was presulfided for 2 hours at 400° C. with a carbon disulfide-saturated stream of hydrogen, flowing at 100 mL/min.

The resulting catalyst was designated Catalyst C.

Catalyst D (inventive) was prepared by physically mixing 15 grams of silicoaluminophosphate powder ("SAPO-5", provided by UOP, Des Plaines, Ill.) with 15 grams of a colloidal silica binder ("Ludox As-40", provided by DuPont, Wilmington, Del.). The mixture was extruded into 1/16" extrudate which was calcined in air at 538° C. for 6 hours. 10.0 grams of the extrudate was impregnated with an aqueous solution containing 20 wt. % ammonium heptamolybdate, 16 wt. % cobalt nitrate, and 20 wt. % citric acid. The impregnated catalyst was then calcined in air at 538° C. for 6 hours. The Co/Mo-modified catalyst was presulfided for 2 hours at 400° C. with a carbon disulfide-saturated stream of hydrogen, flowing at 100 mL/min.

The resulting catalyst was designated Catalyst D.

EXAMPLE II

This example demonstrates that a Co/Mo SAPO catalyst was highly effective for removing sulfur from the heavy fraction of catalytically cracked gas while retaining aromaticity.

Catalyst A (3.85 grams) was place in a stainless steel reactor (1 inch inside diameter) between a top and bottom layer of "Alundum-36"™ (available from PQ Corporation, Valley Forge, Pa). The reactor was brought to hydrodesulfurization reaction conditions of 317° C. and 500 psig. A heavy hydrocarbon feed was charged to the reactor at a weighted hourly space velocity (WHSV) of 1.039 $h^{-1}$. Hydrogen was co-fed to the reactor at a rate of 2.4 liters/hour. The heavy hydrocarbon feed, which was a heavy-cut of catalytically cracked gasoline, had an initial boiling point of 244° F. and a final boiling point of 489° F. The heavy hydrocarbon feed contained about 210 ppmw organic sulfur compounds, about 57.2 wt. % aromatics, about 1.5 wt. % olefins, about 8.0 wt. % naphthenes, about 14.0 wt. % iso-paraffins, about 3.7 wt. % paraffins, about 2.4 wt. % $C_{13}^{+}$hydrocarbons, and about 13.1 wt. % unknowns. Table I shows the hydrodesulfurization and hydrodearomatization characteristics of Catalyst A after 6.73 hours on stream.

Catalyst B (2.92 grams) was place in the above-described reactor. The reactor was brought to hydrodesulfurization reaction conditions of 323° C. and 508 psig. The same heavy hydrocarbon feed employed for Catalyst A was charged to the reactor at a WHSV of 1.370 $h^{-1}$. Hydrogen was co-fed to the reactor at a rate of 2.4 liters/hour. Table I shows the hydrodesulfurization and hydrodearomatization characteristics of Catalyst B after 5.22 hours on stream.

Catalyst C (2.42 grams) was place in the above-described reactor. The reactor was brought to hydrodesulfurization reaction conditions of 323° C. and 520 psig. The same heavy hydrocarbon feed employed for Catalysts A was charged to the reactor at a WHSV of 1.653 $h^{-1}$. Hydrogen was co-fed to the reactor at a rate of 2.4 liters/hour. Table I shows the hydrodesulfurization and hydrodearomatization characteristics of Catalyst C after 5.55 hours on stream.

Catalyst D (2.88 grams) was place in the above-described reactor. The reactor was brought to hydrodesulfurization reaction conditions of 320° C. and 515 psig. The same heavy hydrocarbon feed employed for Catalysts A was charged to the reactor at a WHSV of 1.429 $h^{-1}$. Hydrogen was co-fed to the reactor at a rate of 2.4 liters/hour. Table I shows the hydrodesulfurization and hydrodearomatization characteristics of Catalyst C after 6.00 hours on stream.

TABLE I

| Catalyst | Support | Binder | Co/Mo Impregnations | Hydrodesulfurization (wt. %) | Aromatics Retention (wt. %) |
|---|---|---|---|---|---|
| A | y-$Al_2O_3$ | — | — | 90.0 | 91.2 |
| B | SAPO-5 | silica | sequential | 63.8 | 99.4 |
| C | SAPO-5 | alumina | simultaneous | 51.7 | 97.0 |
| D | SAPO-5 | silica | simultaneous | 84.5 | 99.5 |

The results in Table I demonstrate that a Co/Mo SAPO catalyst was highly effective for removing sulfur from the heavy fraction of catalytically cracked gas while retaining aromaticity.

What is claimed is:

1. A hydrodesulfurization process consisting essentially of contacting a hydrocarbon feed containing a concentration of organic sulfur compounds and a concentration of aromatic compounds with a catalyst composition consisting essentially of a cobalt compound, a molybdenum compound, and a SAPO molecular sieve under conditions sufficient of convert a portion of said concentration of organic sulfur compounds to inorganic sulfur compounds, thereby providing a hydrodesulfurized hydrocarbon product.

2. A process according to claim 1 wherein the weight of the cobalt component of said cobalt compound as a percentage of the total weight of said catalyst composition is from about 0.1% to about 10%.

3. A process according to claim 2 wherein the weight of the molybdenum component of said molybdenum compound as a percentage of the total weight of said catalyst composition is from about 1% to about 50%.

4. A process according to claim 3 wherein said SAPO molecular sieve is selected from the group consisting of SAPO-4, SAPO-5, SAPO-11, SAPO-16, SAPO-17, SAPO-20, SAPO-31, SAPO-34, SAPO-35, SAPO-37, SAPO-40, SAPO-41, SAPO-42, and SAPO-44.

5. A process according to claim 4 wherein said SAPO molecular sieve is SAPO-5.

6. A process according to claim 1 wherein said hydrocarbon feed is a heavy hydrocarbon fraction which boils in the range of from about 200° F. to about 500° F.

7. A process according to claim 6 wherein said concentration of organic sulfur compounds in said hydrocarbon feed is from about 10 ppmw to about 10,000 ppmw, and wherein said concentration of aromatic compounds in said hydrocarbon feed is such that the weight of aromatic compounds as a percentage of the total weight of said hydrocarbon feed is from about 10% to about 95%.

8. A process according to claim 7 wherein the concentration of organic sulfur compounds in said hydrodesulfurized hydrocarbon product is less than 25% of said concentration of organic sulfur compounds in the hydrocarbon feed, and wherein the concentration of aromatic compounds in said hydrodesulfurized hydrocarbon product is more than 90% of said concentration of aromatic compounds in said hydrocarbon feed.

9. A process according to claim 8 wherein said SAPO molecular sieve is SAPO-5.

10. A process according to claim 9 wherein the weight of the cobalt component of said cobalt compound as a percentage of the total weight of said catalyst composition is about 0.5% to about 5%.

11. A process according to claim 10 wherein the weight of the molybdenum component of said molybdenum compound as a percentage of the total weight of said catalyst composition is from about 2% to about 25%.

12. A process according to claim 11 wherein said catalyst composition is pre-sulfided.

13. A hydrodesulfurization process comprising the steps of:

(a) separating a full range hydrocarbon feed containing a first concentration of organic sulfur compounds and a first concentration of aromatic compounds into a heavy hydrocarbon fraction and a light hydrocarbon fraction, wherein said heavy hydrocarbon fraction boils at a temperature above a cut-point temperature, wherein said light hydrocarbon fraction boils at a temperature below said cut-point temperature, and wherein said heavy hydrocarbon fraction contains a second concentration of organic sulfur compounds and a second concentration of aromatic compounds;

(b) contacting said heavy hydrocarbon fraction with a catalyst composition consisting essentially of a cobalt compound present in said catalyst composition as a percentage of the total weight of the catalyst composition is from about 0.1% to about 10%, a molybdenum compound present in said catalyst composition as a percentage of the total weight of the catalyst composition is from about 1% to about 50%, and a SAPO molecular sieve under conditions sufficient of convert a portion of said second concentration of organic sulfur compounds to inorganic sulfur compounds, thereby providing a hydrodesulfurized heavy hydrocarbon product, wherein said hydrodesulfurized heavy hydrocarbon fraction contains a third concentration of organic sulfur compounds and a third concentration of aromatic compounds; and, (c) combining said hydrodesulfurized heavy hydrocarbon product and said light hydrocarbon fraction to produce a hydrodesulfurized full range hydrocarbon product, wherein said hydrodesulfurized full range hydrocarbon product has a fourth concentration of organic sulfur compounds and a fourth concentration of aromatic compounds.

14. A process according to claim 13 wherein said cut-point temperature is from about 150° F. to about 350° F.

15. A process according to claim 14 wherein said first concentration of organic sulfur compounds is from about 5 ppmw to about 5000 ppmw, and wherein said first concentration of aromatic compounds is such that the weight of aromatic compounds as a percentage of the total weight of said full range hydrocarbon fraction is from about 10% to about 50%.

16. A process according to claim 15 wherein said second concentration of organic sulfur compounds is from about 10 ppmw to about 10,000 ppmw, and wherein said second concentration of aromatic compounds is such that the weight of aromatic compounds as a percentage of the total weight of said heavy hydrocarbon fraction is from about 10% to about 95%.

17. A process according to claim 16 wherein said SAPO molecular is selected from the group consisting of SAPO-4, SAPO-5, SAPO-11, SAPO-16, SAPO-17, SAPO-20, SAPO-31, SAPO-34, SAPO-35, SAPO-37, SAPO-40, SAPO-41, SAPO-42, and SAPO-44.

18. A process according to claim 13 wherein said cut-point temperature is from 200° F. to 300° F.

19. A process according to claim 18 wherein said first concentration of organic sulfur compounds is from about 50 ppmw to about 1000 ppmw, and wherein said first concentration of aromatic compounds is such that the weight of aromatic compounds as a percentage of the total weight of said full range hydrocarbon fraction is from about 20% to about 40%.

20. A process according to claim 19 wherein said second concentration of organic sulfur compounds is from about 100 ppmw to about 2000 ppmw, and wherein said second concentration of aromatic compounds is such that the weight of aromatic compounds as a percentage of the total weight of said heavy hydrocarbon fraction is from about 30% to about 90%.

21. A process according to claim 20 wherein said SAPO molecular sieve is SAPO-5.

* * * * *